US007717749B2

(12) United States Patent
Chen et al.

(10) Patent No.: US 7,717,749 B2
(45) Date of Patent: May 18, 2010

(54) MULTIPORT RJ CONNECTOR

(75) Inventors: John Chen, Danville, CA (US); Kwok Fai Lai, Kowloon (HK); Kuok Sang Leong, Kowloon (HK); Man Tat Yip, Kowloon (HK); Wai Shun Leung, Kowloon (HK); Chun Wing Ng, Kowloon (HK); Quincy Lee, Kowloon (HK)

(73) Assignee: Bel Fuse, Inc., Jersey City, NJ (US)

( * ) Notice: Subject to any disclaimer, the term of this patent is extended or adjusted under 35 U.S.C. 154(b) by 965 days.

(21) Appl. No.: 10/657,343

(22) Filed: Sep. 8, 2003
(Under 37 CFR 1.47)

(65) Prior Publication Data

US 2005/0059295 A1 Mar. 17, 2005

Related U.S. Application Data

(63) Continuation of application No. 09/921,056, filed on Aug. 2, 2001, now abandoned.

(60) Provisional application No. 60/222,710, filed on Aug. 3, 2000.

(51) Int. Cl.
*H01R 13/68* (2006.01)

(52) U.S. Cl. ..... 439/620.22; 439/620.18; 439/541.5; 439/76.1

(58) Field of Classification Search ..... 439/607, 439/608, 620.15–620.19, 620.21–620.23, 439/676, 941, 344, 541, 79, 541.5, 620, 76.1
See application file for complete search history.

(56) References Cited

U.S. PATENT DOCUMENTS

| | | | | |
|---|---|---|---|---|
| 5,531,612 | A * | 7/1996 | Goodall et al. | 439/541.5 |
| 5,865,934 | A * | 2/1999 | Yamamoto et al. | 29/844 |
| 6,132,260 | A * | 10/2000 | Wu | 439/676 |
| 6,171,152 | B1 * | 1/2001 | Kunz | 439/620 |
| 6,183,308 | B1 * | 2/2001 | Laity | 439/676 |
| 6,840,817 | B2 * | 1/2005 | Chen | 439/676 |

* cited by examiner

*Primary Examiner*—Felix O Figueroa
(74) *Attorney, Agent, or Firm*—Ostrolenk Faber LLP

(57) ABSTRACT

A multiport connector which includes a housing having at least two aligned compartments, each compartment being structured and arranged to receive respective plugs. A multilayer printed wiring board separates the two compartments, the printed wiring board having circuit patterns on opposite sides of opposed non-conductive layers and a metal shielding layer intermediate the non-conductive layers. A first plurality of conductive contact fingers is disposed in one of the compartments, the first plurality of fingers having first portions for making electrical contact with one of the plugs and second portions for making contact with the circuit pattern on one of the non-conductive layers of the multilayer printed wiring board. A second plurality of conductive contact fingers is disposed in the other of the compartments, the second plurality of fingers having first portions for making electrical contact with the other one of the plugs and second portions for making contact with the circuit pattern on the other one of the non-conductive layers of the multilayer printed wiring board.

4 Claims, 7 Drawing Sheets

MULTIPORT RJ CONNECTOR

RELATED APPLICATION

This application is a continuation of application Ser. No. 09/921,056 filed Aug. 2, 2001 now abandoned entitled "MULTIPORT RJ CONNECTOR" which application is based on Provisional Application Ser. No. 60/222,710, filed Aug. 3, 2000, entitled "MULTIPORT RJ JACK CONNECTOR" and claims priority thereto. The entire disclosure of Provisional Application Ser. No. 60/222,710 is incorporated by reference herein.

BACKGROUND OF THE INVENTION

The present invention relates to RJ Connectors and, in particular, to a multiport RJ connector which is shielded to enable use at high frequencies (e.g., gigabit frequencies).

RJ Connectors are modular connectors used in telecommunications and data networks to interconnect equipment units. As the need for speed of such equipment increases, the frequencies of the signals employed in such equipment also increase. At the same time, there is a need to make the equipment more compact. The use of high frequencies combined with increased compactness of the equipment leads to increased problems of unwanted interactions between the signals carried by the connectors.

SUMMARY OF THE INVENTION

Accordingly, it is an object of the present invention to provide a more compact arrangement of RJ connectors and, more particularly, to provide a multiport RJ connector having improved shielding.

The foregoing and other objects are achieved in accordance with certain principles of the invention by a multiport connector, which comprises a housing having at least two aligned compartments, each compartment being structured and arranged to receive respective plugs. A multilayer printed wiring board separates the two compartments, the printed wiring board having circuit patterns on opposite sides of opposed non-conductive layers and a metal shielding layer intermediate the non-conductive layers. A first plurality of conductive contact fingers is disposed in one of the compartments, the first plurality of fingers having first portions for making electrical contact with one of the plugs and second portions for making contact with the circuit pattern on one of the non-conductive layers of the multilayer printed wiring board. A second plurality of conductive contact fingers is disposed in the other of the compartments, the second plurality of fingers having first portions for making electrical contact with the other one of the plugs and second portions for making contact with the circuit pattern on the other one of the non-conductive layers of the multilayer printed wiring board.

In accordance with one aspect of the invention, the conductive contact fingers are resilient such that the second portions make contact with the circuit patterns by spring action forcing the second portions into electrical contact with the respective circuit patterns. This feature, referred to herein as the edge connector feature because this arrangement functions similar to an edge connector, allows electrical contact to be made without any physical joining, such as by welding or the like.

In accordance with another aspect of the invention, the edge connector feature is employed in a single connector in which only one plurality of contact fingers is employed with the second portions of the contact fingers making contact with the circuit pattern on a printed wiring board by means of spring pressure.

Other features and advantages of the present invention will become apparent from the following description of the invention which refers to the accompanying drawings.

DETAILED DESCRIPTION OF EMBODIMENTS OF THE INVENTION

Figure 2:
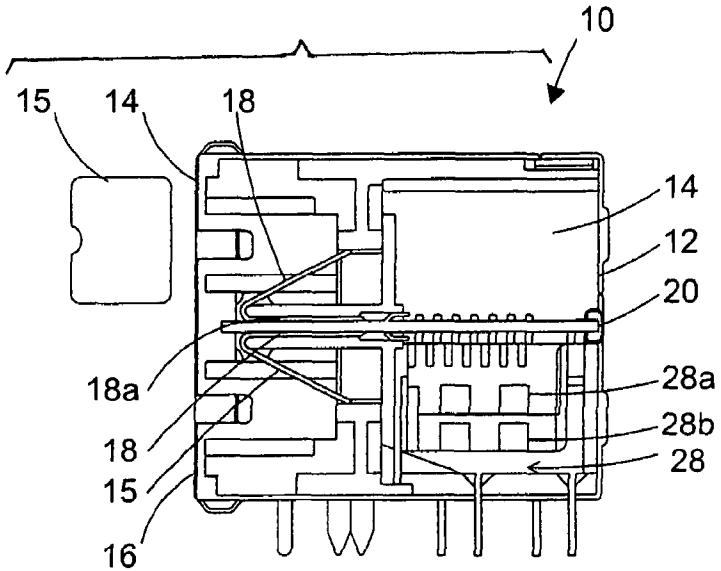
FIG. 2 is a side view of the multiport connector of FIG. 1.
Figure 1:
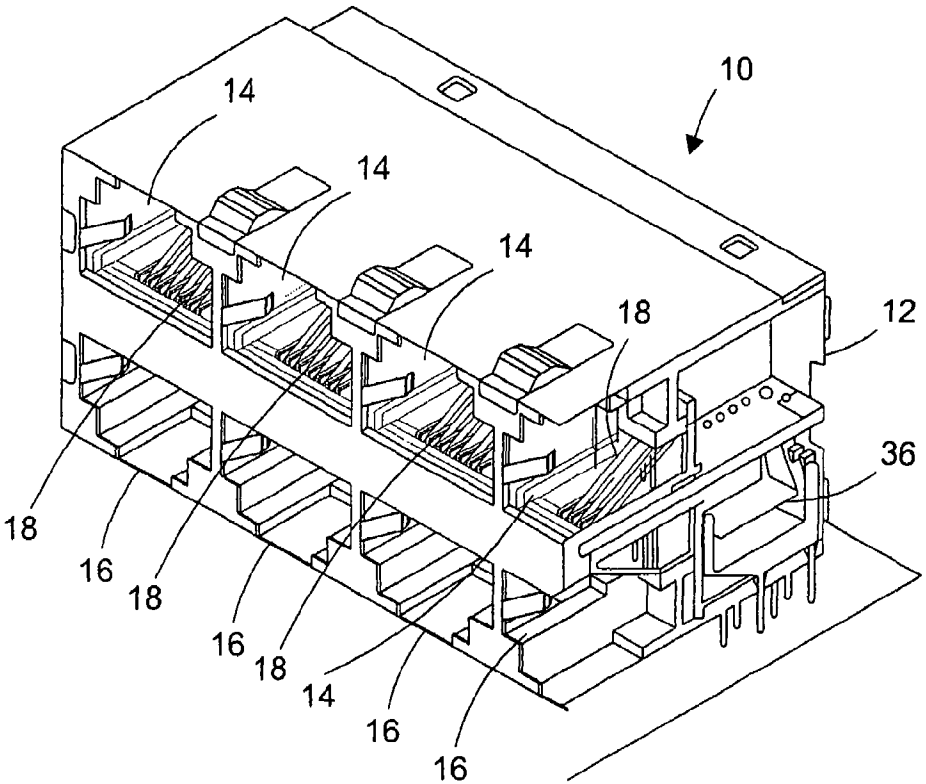
FIG. 1 is a perspective view of a multiport connector in accordance with certain aspects of the invention.

FIGS. 1 and 2 show a multiport connector 10 in a stacked configuration which includes a plastic housing 12 having compartments for receiving RJ connector components, such as those disclosed in Ser. No. 09/492,895, filed Jan. 27, 2000 and entitled "RJ Jack With Integrated Interface Magnetics", the entire disclosure of which is incorporated by reference herein.

More specifically, the compartments, which function as individual RJ connectors, are arranged in vertically aligned pairs of upper and lower compartments 14 and 16, respectively, with each compartment being shaped and dimensioned to receive a conventional modular RJ plug 15 (only one of which is diagrammatically shown in FIG. 2). Each component 14, 16 includes a plurality of resilient conductive contact fingers 18 which project upwardly at an angle towards the rear wall of the compartment for receiving and making contact with the modular plugs.

Figure 3:
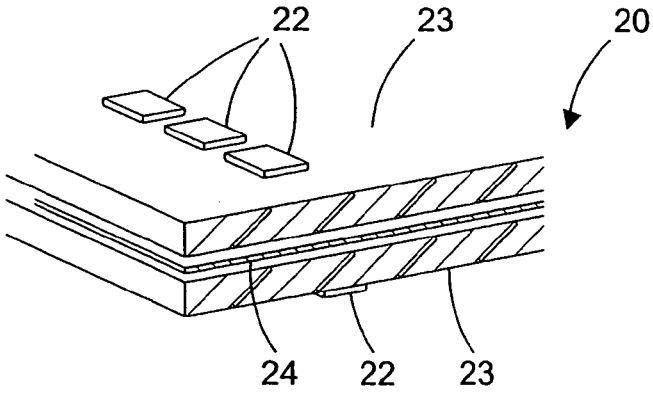
FIG. 3 is a perspective view of a multilayer board used in the multiport connector of FIG. 1.
Figure 4:
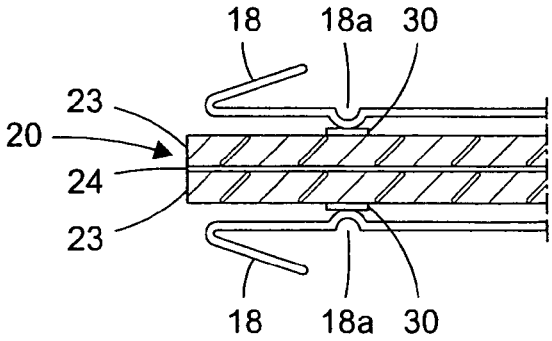
FIG. 4 is a fragmented elevational view of the multilayer board of FIG. 3 sandwiched between conductive fingers.

Referring to FIGS. 3 and 4, the opposing portions 18*a* of the fingers 18 make contact with a multilayer printed wiring board 20 having circuit patterns 22 on opposed external surfaces of non-conductive layers 23 which sandwich an internal metal shielding layer 24. The shielding layer 24 serves to electrically shield the components in the upper and lower compartments 14 and 16 from each other.

One of the compartments, in this case the lower compartment 16, includes a toroid base unit 28, which houses two sets of magnetic toroid units 28*a* and 28*b* (FIG. 2) functioning as filters or transformers, one set for the upper compartment 14 and one set for the lower compartment 16.

The contact between the fingers 18 and the printed circuit board 20 is a pressure contact, in which bumps 30 on the opposing portions 18 of the opposing fingers 18 (best shown in FIG. 4) make contact with pads on the circuit patterns 22 on the opposite sides of the printed circuit board 20. The opposing portions 18*a* with the protruding bumps 30 function as an edge connector (FIG. 4); that is, the printed circuit board 20 is sandwiched between the respective fingers 18 in the upper and lower compartments 14 and 16 with electrical contact being established by pressure exerted by the fingers 18 in a manner similar to the functioning of a conventional edge connector. As in an edge connector, the pressure results from a spring force being exerted by the resilient fingers 18 on the circuit patterns 22. This edge connector feature enables good electrical contact to be made between the fingers 18 and the circuit patterns 22 without the need for physical joining by soldering or the like.

The individual components and their assembly to form a multiport RJ connector will now be described.

FIGS. 5(*a*) to 5(*g*) show the assembly of a set of contact fingers 18 to a contact pin assembly 34. Referring to FIG. 5(*a*), each of the fingers 18 initially form part of a lead frame 32 having tie bars 31(*a*) and 31(*b*) on opposite ends. Each of the lead frames 32 is subjected to a forming process, known as spoon contact forming, to first form the bumps 30 or depressions (FIG. 5(*b*)) and then a bending process, referred to as 30° forming, to bend the lead frame into a 30° angle (FIG. 5(*c*). Other angles may be used with the angle of the bending being selected such as to optimize contacts force to this end. Additionally, rather than a single bend, multiple bends may be used. After the lead frame has been bent, the tie bar 31(*a*) is severed from the lead frame 32. Then the lead frame 32 is assembled with the contact pin block 34.

The contact pin block 34 has a plurality of slots 35(*a*) and 35(*b*) on opposite sides 34(*a*) and 34(*b*) of the contact pin block 34 for receiving the contact fingers 18. The spacing of the slots 35(*a*) and the contact fingers 18 on the side 34*a* of the contact pin block assembly 34 (which is the side that receives the modular plug 15, (FIG. 2)), is such as to match the spacing of the contacts in the modular plug 15. However, on the opposite side 34*b*, the spacing of the slots 35(*b*) and the contact fingers 18 is increased so as to reduce cross talk and facilitate connection of the contacts 18 to the printed circuit board 20. After assembly of the lead frame 32 to the contact pin block 34, the lead frame 32 is subjected to ultrasonic energy to ultrasonically melt the contact pin block 24 to secure the lead frame 32 to the contact block 34. The tie bar 31(*b*) is then severed from the lead frame 32 (FIG. 5(*g*)).

Figure 6C:
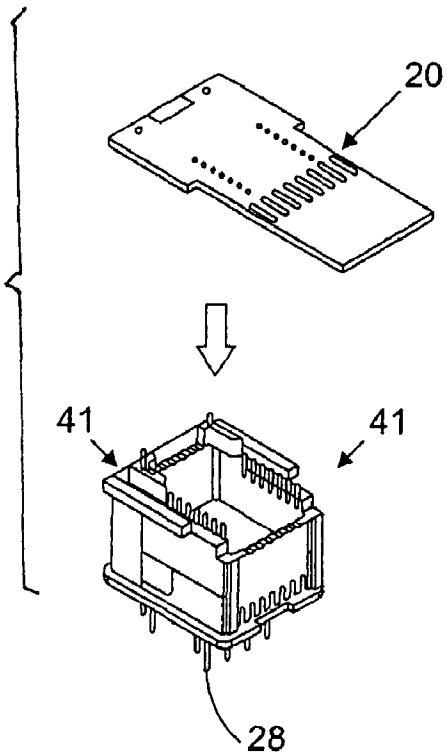
Figure 6B:
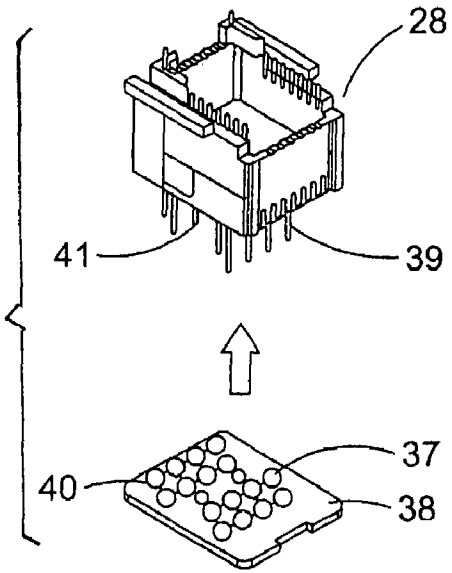
Figure 6A:
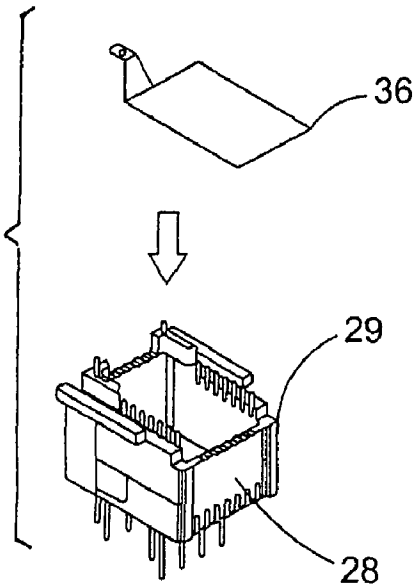

Assembly of a toroid base unit 28 is shown in FIGS. 6(*a*)-6(*c*). The toroid base unit 28 includes a rectangular plastic housing 29 for receiving one set 28*a* of the toroids (FIG. 2), which may be separated from a second set 28(*b*) of toroids (FIG. 2) by a metal separator 36 (FIG. 6(*a*)). Alternatively, the metal separator 36 may be omitted. The toroid base unit 28 is then assembled to a bottom plate 38 (FIG. 6(*b*)). The plate 38 includes a plurality of openings 37 for receiving depending conductive pins 39 depending from the bottom of the toroid base assembly 28 and holes 40 for receiving mounting posts 41 (only one of which is seen in FIG. 6(*b*)), also depending from the bottom of the toroid base assembly 28 The top ends of pins 39 are electrically connected to the toroid units and the bottom ends are connected to an external circuit (not shown).

As seen in FIG. 6, the printed wiring board 20 is then assembled to the toroid base unit 28 by placing the printed wiring board 20 over the toroid base unit 28 with the conductive pins 41 in the toroid base unit, which are electrically connected to the toroid units, extending through corresponding holes in the printed wiring board 20. The conductive pins 41 are then soldered to the circuit patterns 22.

Figure 7B:
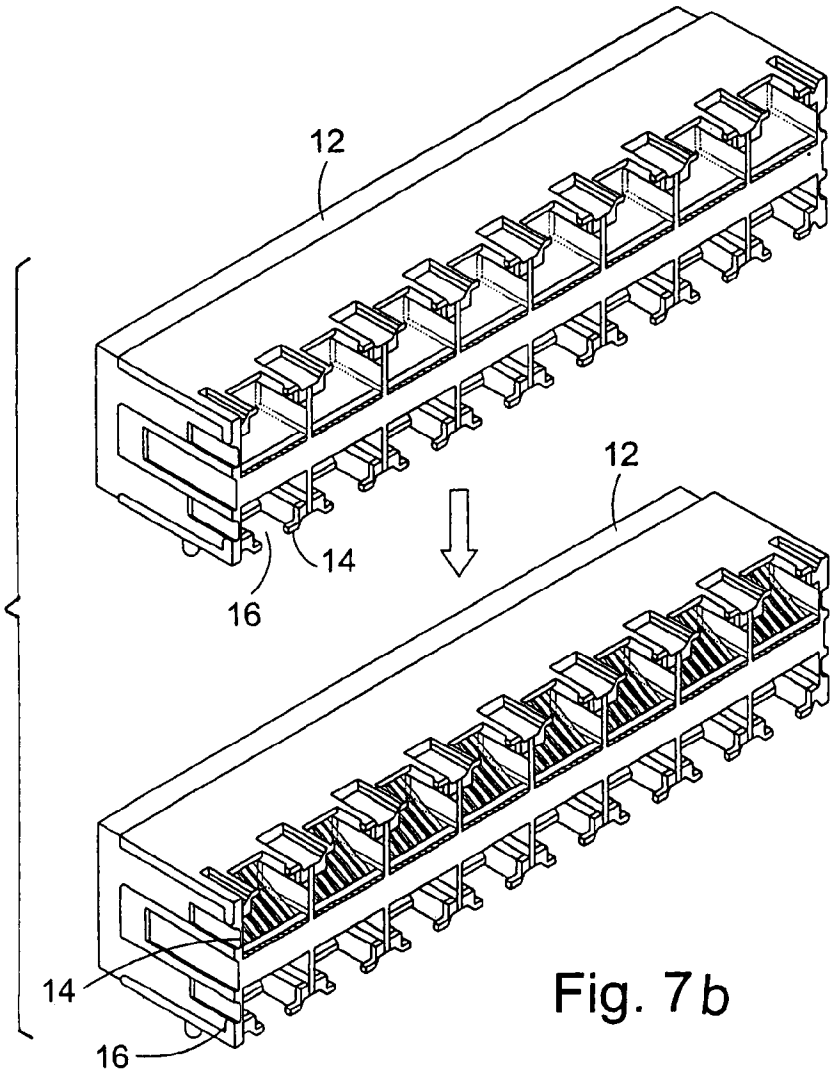
Figure 7A:
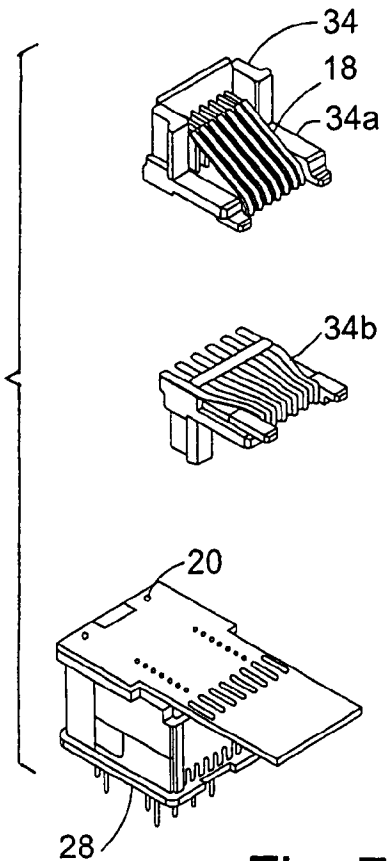
Figure 8:
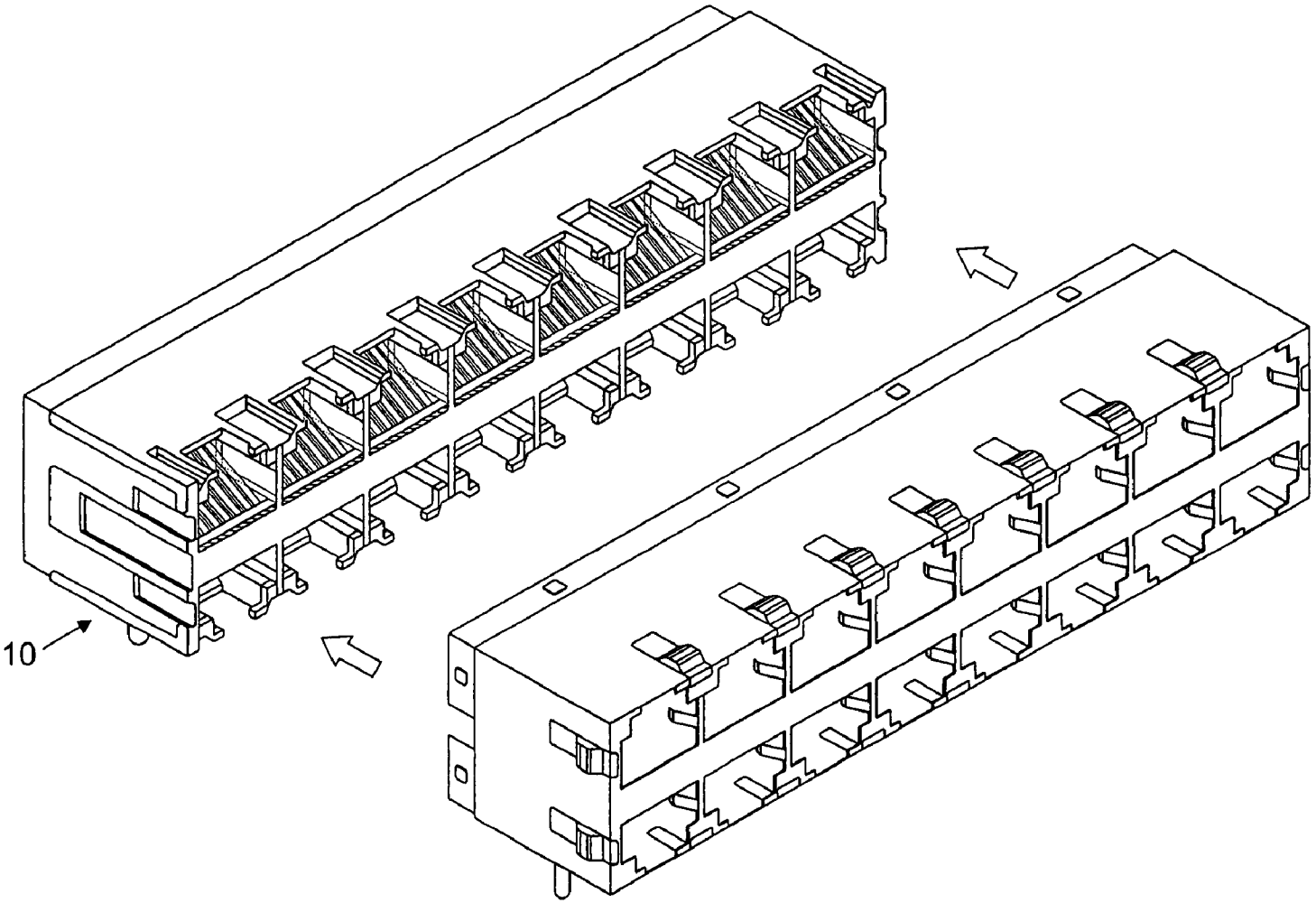
FIG. 8 and FIG. 9 are perspective views showing the component parts of the multiport connector of FIGS. 1 and 2, as well as the method of assembly of the component parts into the multiport connector.
Figure 9:
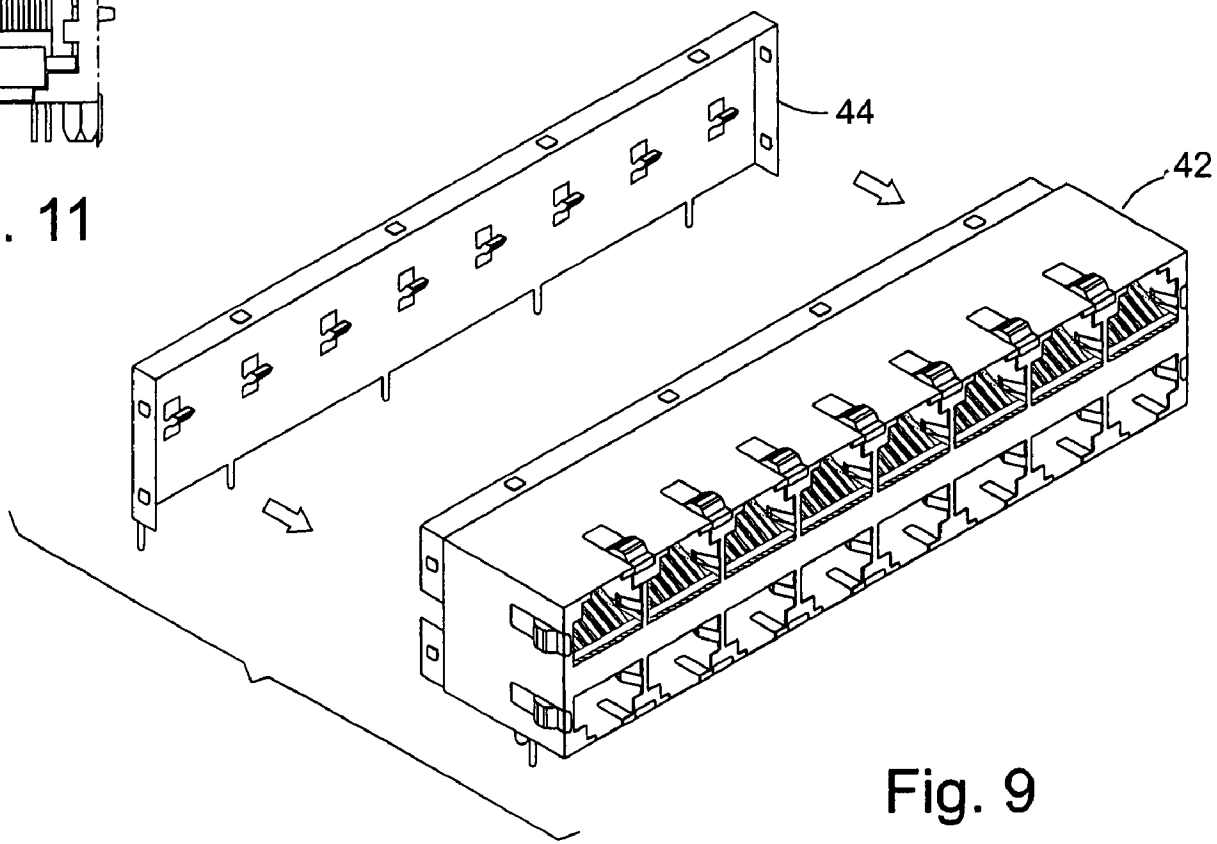

Referring to FIGS. 7(*a*) and 7(*b*), the toroid base unit 28 with the printed wiring board 20 is then inserted into the housing 12, as are the upper and lower contact pin block assemblies 34. The contact pin block assemblies 34 are inserted into the upper and lower compartments 14 and 16 inverted from each other such that their portions 18*a* oppose each other and make a pressure contact with pads on the printed wiring board 20. Thereafter, as shown in FIG. 8, a front metal shield 42 is put on the assembly followed by a rear metal shield 44 (FIG. 9).

It should be appreciated that, although FIGS. 5(*a*)-5(*g*), 6(*a*)-6(*c*) and 7(*a*) and 7(*b*) illustrate the assembly of components for one set of upper and lower compartments 14 and 16, in practice, components will be assembled for the number of RJ Connectors required for a particular application (see, e.g., FIG. 1, which shows four sets of RJ connectors, that is, eight RJ connectors).

It should also be appreciated that shielding is not only effected by the front and rear shields 42 and 44, but also by the shielding layer(s) 24 of the printed wiring board(s) 20.

Further, although the toroid assembly 28 has been shown and described as being in the lower compartment 16, it may, instead, be in the upper compartment 14.

Additionally, although the compartments 14, 16 are described as being vertically aligned, they may alternatively be aligned horizontally.

Figure 10:
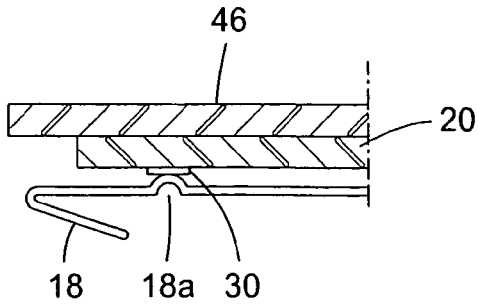
FIG. 10 is a fragmented elevational view of a multilayer board and conductive fingers according to an alternative embodiment of the invention.
Figure 5A:
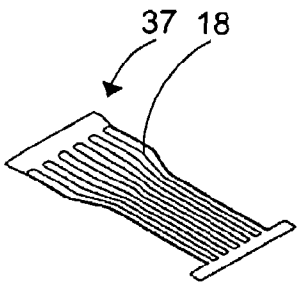
FIGS. 5(*a*)-5(*g*), FIGS. 6(*a*)-6(*c*), FIGS. 7(*a*) and 7(*b*)
Figure 5B:
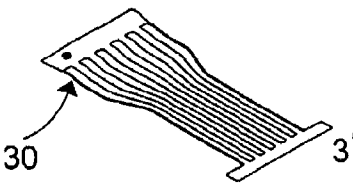
Figure 5C:
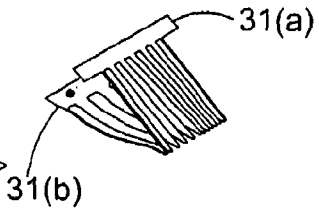
Figure 5D:
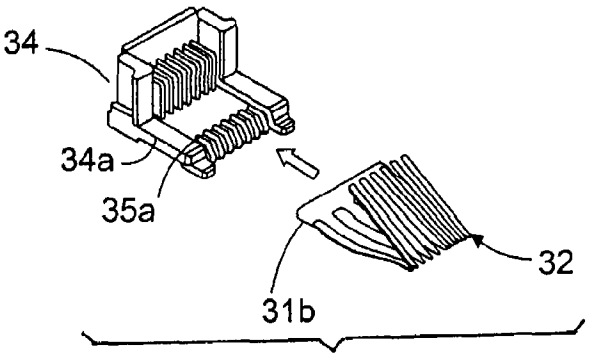
Figure 5E:
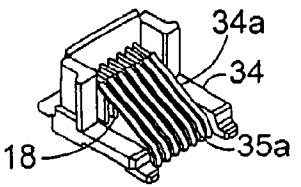
Figure 5F:
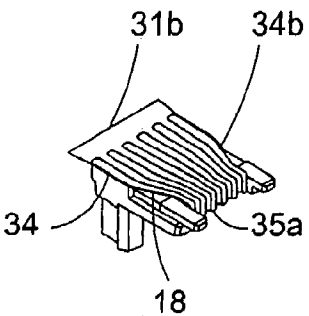
Figure 5G:
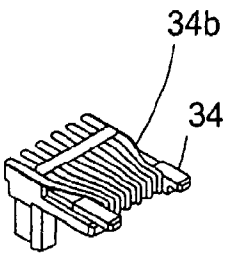

Further, although the edge connector feature has been illustrated and described as being used in connection with a multiport RJ connector, it may also be used for a single unit, as shown in FIG. 10, with a wall 46 or the housing in contact with one of the surfaces of the board 20, while the other surface, i.e., the surface with a circuit pattern, is engaged by the bumps 30 of the contact finger portions 18*a* being pressed into contact with the circuit pattern by the spring force of the contacts 18.

In co-pending application entitled "RJ Jack With Integrated Interface Magnetics", U.S. Ser. No. 09/492,895, filed Jan. 27, 2000, the entire disclosure of which is incorporated by reference herein, an RJ Connector Jack design is disclosed that, instead of physically imbedding LEDs inside the connector at the front face of the jack, mounts the LEDs at the rear of the package. Means are provided, such as a transparent top wall, for coupling light from the LEDs, which are positioned at the rear of the connector, to the front panel of the connector.

Figure 11:
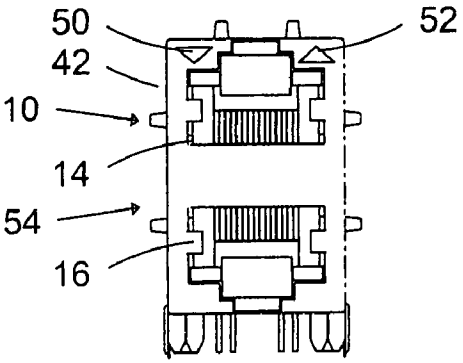
FIG. 11 is a fragmented elevational view of an embodiment of the multiport connector of FIGS. 1 and 2 which includes LEDs.

As shown in FIG. 11, this feature may be incorporated in the multiport connector 10. Light from LEDs (not shown) mounted at the rear of the connector 10 is directed to triangular shaped status indicators 50 and 52 located at the top portion of the connector's front face plate 42. These indicators 50, 52 are comprised of the end portions of the light coupling structure and matching triangular shaped cut-outs in the sheet metal case 42. Each two-port section 54 (i.e., each set of upper and lower compartments 14 and 16) is typically configured with one downward pointing triangular shaped indicator 50 at the top left portion of the section and one upward pointing triangular shaped indicator 52 at the top right portion of the section. Each two-port section 54 of the multiport connector 10 has the same arrangement. For each two-port section 54, the downward pointing indicator 50 applies to the lower compartment 16, while the upward pointing indicator 52 applies to the upper compartment 14. Each indicator 50, 52 may be configured with a single or bi-colored rear mounted LED to provide a single or multitude of colored lights showing at the face plate triangle 50, 52 to indicate the operational status of that particular compartment.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A multiport connector, which comprises:

a housing having at least two aligned compartments, each compartment being structured and arranged to receive respective plugs;

a multilayer printed wiring board separating the two compartments, the printed wiring board having circuit patterns on opposite sides of opposed non-conductive layers and a metal shielding layer intermediate the non-conductive layers;

a first plurality of conductive contact fingers in one of the compartments, the first plurality of fingers having first portions for making electrical contact with one of the plugs and second portions for making contact with the circuit pattern on one of the non-conductive layers of the multilayer printed wiring board; and a second plurality of conductive contact fingers in another of the compartments, the second plurality of fingers having first portions for making electrical contact with another one of the plugs and second portions for making contact with the circuit pattern on another one of the non-conductive layers of the multilayer printed wiring board, wherein one of the compartments has a toroid assembly housing for housing two sets of toroids, one set for one compartment and the other set for another compartment and the toroid assembly housing has a metal separator for separating one set of toroids from the other set of toroids, wherein the first plurality of conductive contact fingers and the second plurality of conductive contact fingers are resilient and make contact with the circuit patterns by spring action forcing the second portions into electrical contact with the respective circuit patterns.

2. A multiport connector in accordance with claim 1 wherein the compartments are upper and lower vertically aligned compartments.

3. A multiport connector in accordance with claim 2, wherein the housing has a front face and a rear face and metallic shields are disposed on the front and rear faces.

4. A multiport connector, which comprises:

a housing having a plurality of sets of upper and lower vertically aligned compartments, each compartment being structured and arranged to receive respective plugs;

a multilayer printed wiring board separating the upper and lower compartments of each set, the printed wiring board having circuit patterns on opposite sides of opposed non-conductive layers and a metal shielding layer intermediate the non-conductive layers;

a first plurality of conductive contact fingers in one of the compartment of each set, the first plurality of fingers having first portions for making electrical contact with one of the plugs and second portions for making electrical contact with the circuit pattern on one of the non-conductive layers of the multilayer board separating the upper and lower compartments of said set; and a second plurality of conductive contact fingers in the other of the compartments, the second plurality of fingers having first portions for making electrical contact with the other one of the plugs and second portions for making contact with the circuit pattern on the other one of the non-conductive layers of the multilayer printed wiring board, wherein one of the compartments of each set of upper and lower compartments has a toroid assembly housing for housing two sets of toroids, one set of toroids for one compartment and the other set of toroids for the other compartment and the toroid assembly housing has a metal separator for separating one set of toroids from the other set of toroids, wherein the first plurality of conductive contact fingers and the second plurality of conductive contact fingers are resilient and make contact with the circuit patterns by spring action forcing the second portions into electrical contact with the respective circuit patterns.

* * * * *